US009242447B2

(12) United States Patent
Abergel et al.

(10) Patent No.: US 9,242,447 B2
(45) Date of Patent: Jan. 26, 2016

(54) DEVICE FOR CONTROLLING THE DEPOSITION OF COLOURED SUBSTANCE(S) AND OF WETTING SOLUTION FOR AN OFFSET PRINTING SYSTEM AND METHOD FOR IMPLEMENTING THE DEVICE

(71) Applicants: MGI FRANCE, Ivry sur Seine (FR); INK JET TECHNOLOGY, Ivry sur Seine (FR)

(72) Inventors: Edmond Abergel, Paris (FR); Louis Gautier-Le-Boulch, Meudon (FR)

(73) Assignees: MGI FRANCE, Ivry sur Seine (FR); INK JET TECHNOLOGY, Ivry sur Seine (FR)

( * ) Notice: Subject to any disclaimer, the term of this patent is extended or adjusted under 35 U.S.C. 154(b) by 0 days.

(21) Appl. No.: 14/398,179

(22) PCT Filed: May 7, 2013

(86) PCT No.: PCT/EP2013/059543

§ 371 (c)(1),
(2) Date: Oct. 31, 2014

(87) PCT Pub. No.: WO2013/167629

PCT Pub. Date: Nov. 14, 2013

(65) Prior Publication Data

US 2015/0083006 A1 Mar. 26, 2015

(30) Foreign Application Priority Data

May 7, 2012 (FR) ..... 12 54182

(51) Int. Cl.
*B41F 7/02* (2006.01)
*B41M 1/06* (2006.01)
(Continued)

(52) U.S. Cl.
CPC ... *B41F 7/02* (2013.01); *B41F 7/30* (2013.01); *B41F 31/08* (2013.01); *B41F 31/20* (2013.01); *B41F 35/02* (2013.01); *B41J 2/0057* (2013.01); *B41M 1/06* (2013.01); *B41N 3/08* (2013.01)

(58) Field of Classification Search
CPC ..... B41F 31/28; B41F 31/08; B41F 7/30; B41F 7/24; B41F 7/00; B41F 7/02; B41M 1/06
See application file for complete search history.

(56) References Cited

U.S. PATENT DOCUMENTS 4,287,827 A * 9/1981 Warner ..... B41F 7/24 101/141
6,109,746 A * 8/2000 Jeanmaire ..... B41J 2/0057 347/103
6,241,344 B1 * 6/2001 Machida ..... B41J 2/14161 347/56
2003/0038871 A1 2/2003 Shinkoda et al.
2003/0081043 A1 5/2003 Klausbruckner et al.
(Continued)

FOREIGN PATENT DOCUMENTS

GB 2 381 239 4/2003
JP 2010241131 A * 10/2010 ..... B41F 7/02

OTHER PUBLICATIONS

International Search Report for corresponding International Application No. PCT/EP2013/059543, mailed Jul. 24, 2013.

*Primary Examiner* — Matthew G Marini
*Assistant Examiner* — Ruben Parco, Jr.
(74) *Attorney, Agent, or Firm* — Hauptman Ham, LLP

(57) ABSTRACT

The present invention relates to a substance(s) deposition control device for an offset printing system, characterized in that it comprises:—at least one offset plate intended to receive a wetting liquid and a colored substance in succession,—at least one controlled-deposition means for each offset plate, the deposition means comprising at least one deposition head spraying at least one wetting solution and at least one deposition head spraying a defined colored substance,—at least one means for cleaning the offset plate, and in that the covering of the offset plate or plates comprises a mesh structure defined by a plurality of hydrophilic and lipophilic individual surfaces capable of receiving a controlled deposition of wetting liquid and/or colored substance, each of these hydrophilic and lipophilic surfaces being separated from its direct neighbors by at least one hydrophobic and lipophobic peripheral surface.

17 Claims, 4 Drawing Sheets

Figure 1:
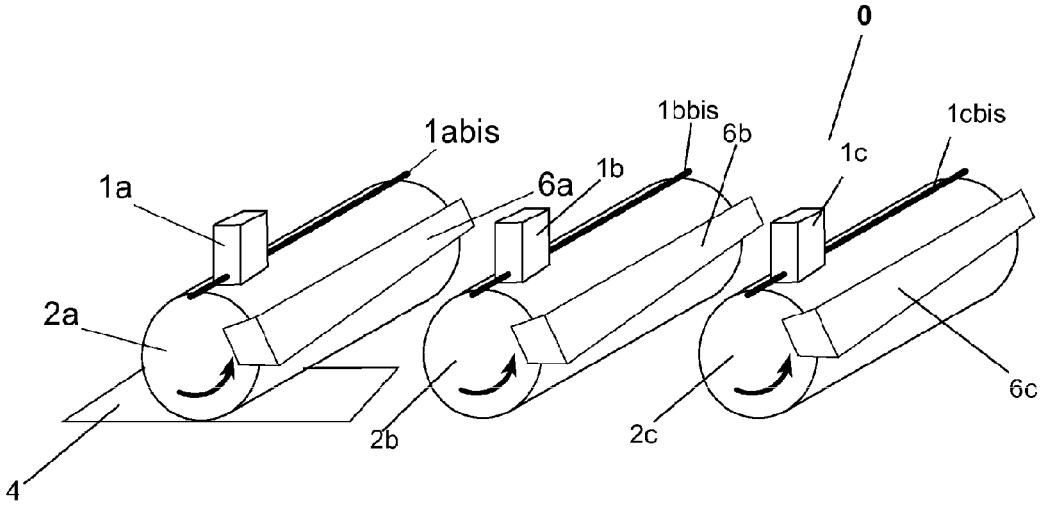

(51) Int. Cl.

| | |
|---|---|
| ***B41J 2/005*** | (2006.01) |
| ***B41F 7/30*** | (2006.01) |
| ***B41F 31/08*** | (2006.01) |
| ***B41F 31/20*** | (2006.01) |
| ***B41F 35/02*** | (2006.01) |
| *B41N 3/08* | (2006.01) |

(56) References Cited

U.S. PATENT DOCUMENTS

| | | | | |
|---|---|---|---|---|
| 2003/0227503 | A1 | 12/2003 | Klausbruckner et al. | |
| 2015/0114244 | A1* | 4/2015 | Abergel ..... | B41F 35/06 101/423 |

* cited by examiner

DEVICE FOR CONTROLLING THE DEPOSITION OF COLOURED SUBSTANCE(S) AND OF WETTING SOLUTION FOR AN OFFSET PRINTING SYSTEM AND METHOD FOR IMPLEMENTING THE DEVICE

The present invention relates to the field of offset printing systems and more particularly the field of devices for control of the wetting step for these printing systems.

Offset printing systems execute a major method among different current printing methods. This method flows directly from the earlier lithographic printing method, with the notable difference that it enables greater operating flexibility by allowing printing of several thousand copies on a wide variety of substrates (papers, polymer cartons . . . ). Lithographic printing methods are flat printing methods. It is considered here that offset printing methods utilise curved printing plates.

The principle of offset printing is based on the principle of water-grease repelling by creating an emulsion between an aqueous wetting solution and a greasy ink successively deposited on a plate etched in copper and aluminium known as offset. The etched plate comprises the image to be printed by the offset method. During the wetting step the aqueous solution is deposited to adhere to the aluminium parts of the surface of the plate, while during inking the greasy ink is repelled by the water on the copper parts of the plate. The ink now deposited on the offset plate is transmitted to an intermediate printing roller called a printing blanket, before being transferred to the definitive substrate. Such a printing technique has proven itself in terms of quality and enables production of a substantial quantity of printed substrate without alteration to the finish. However, this technique comprises the drawback of having an image to be printed which depends on etching of the offset plate. Also, if this technique limits printing wear over time, it does not mean any less a consequent cost when a piece of the machinery must be replaced. This cost is therefore important to each of the replacements of the etched offset plate, that is, sometimes when it breaks, but above all more commonly each time the image to be printed must be changed for printing a new image.

The aim of the present invention is to eliminate this drawback of the prior art by proposing a device capable of carrying out printing which retains the advantages and the properties of the offset method but which also reduces production and manufacturing costs of machinery for printing a new image.

This aim is achieved by a matter deposition control device for offset printing system characterized in that it comprises:

- at least one offset plate intended to receive successively a wetting liquid and a coloured matter,
- at least one controlled deposit means for each offset plate, the deposit means comprising at least one deposit head projecting at least one wetting solution and at least one deposit head projecting a defined coloured matter,
- at least one cleaning means of offset plates, and in that the coating of the offset plate or offset plates comprises a mesh structure defined by a plurality of hydrophilic and lipophilic unit surfaces likely to receive controlled deposit of wetting liquid and/or coloured matter, each of these hydrophilic and lipophilic surfaces being separated from its direct neighbours by at least one peripheral hydrophobic and lipophobic surface.

According to another particular feature, each deposit head comprises at least one nozzle controlled individually by a computer system and a digital file, each head of a deposit means being intended to project at least one wetting solution or a coloured matter on a surface of an offset plate so that all the projections produce an image and/or a text on the surface of the offset plate corresponding to the image and/or the text of the digital file corresponding to the coloured matter projected by the deposit head projecting a coloured matter and in negative for the head(s) projecting a wetting solution.

According to another particular feature, the mesh structure comprises unit surfaces of rectangular form arranged relative to each other so as to form checkering of the surface.

According to another particular feature, the mesh structure comprises unit surfaces of hexagonal form arranged relative to each other so as to form a honeycomb meshing of the surface.

According to another particular feature, the value of the width of a peripheral lipophobic and hydrophobic surface corresponds to a value between 5 to 50% of the width of a lipophilic and hydrophilic unit surface.

According to another particular feature, the width of a unit surface likely to receive wetting liquid or the coloured matter is at least equal to or greater than 35 μm.

According to another particular feature, the width of a unit surface likely to receive wetting liquid or the coloured matter is at least equal to 5 μm.

According to another particular feature, the offset plate(s) are set in motion by displacement means, the displacement means setting the offset plate in motion incrementally between each deposit of wetting solution and/or coloured matter deposited by the nozzle(s) at the centre of at least one unit surface, each increment corresponding to the size of a demi-cell.

According to another particular feature, the number of offset plates corresponds to the number of basic colours.

The invention also relates to a printing system characterized in that it integrates a control device of the wetting according to the invention.

According to another particular feature, the printing system also comprises a drying device intended to dry the wetting solution and/or the coloured matters deposited on the substrate.

According to another particular feature, the system comprises a counterpressure cylinder for each offset plate, the substrate passing between the counterpressure cylinder(s) and the offset plate(s).

According to another particular feature, the system comprises at least one printing blanket for each offset plate, the substrate passing between the counterpressure cylinder(s) and the printing blanket(s).

The invention also relates to a method printing operating at least one device according to the invention, characterized in that it comprises successively at least:

- at least one step for controlled deposit of wetting solution on the offset plate comprising a plurality of hydrophilic and lipophilic unit surfaces separated by peripheral hydrophobic and lipophobic surfaces by the nozzle(s) for deposit of the wetting solution of the deposit means of an offset plate,
- at least one step for controlled deposit of coloured matter on the offset plate with repelling of the coloured matter by the peripheral lipophobic and hydrophobic peripheral surfaces of the offset plate by the nozzle(s) for deposit of coloured matter of the deposit means of the same offset plate,
- a carryover step of the wetting solution and of the coloured matter deposited on the offset plate on a substrate, all of these steps being repeated successively for each offset plate.

According to another particular feature, prior to the steps for controlled deposit of wetting solution of controlled deposit of coloured matter and carryover, the method comprises:

- a preparation step of the image to be printed comprising at least determination and programming of the part(s) of the surface of the offset plate intended to receive of the wetting solution and/or of the coloured matter,
- a transfer step of programmed data corresponding to the image to be printed to the matter(s) deposition control device.

According to another particular feature, the steps for controlled deposit of wetting solution, of controlled deposit of coloured matter and carryover are repeated for each offset plate corresponding to each basic colour.

According to another particular feature, following the steps for controlled deposit of wetting solution, of controlled deposit of coloured matter and carryover performed for all the offset plates, the method comprises a drying step by a drying device of the wetting solution and the coloured matters.

Figure 2:
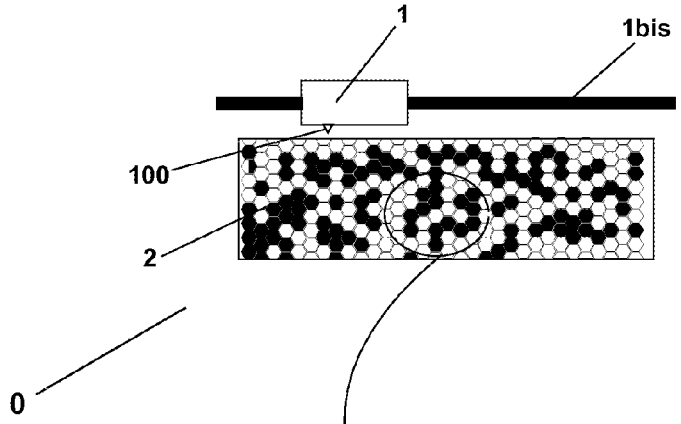
Figure 2B:
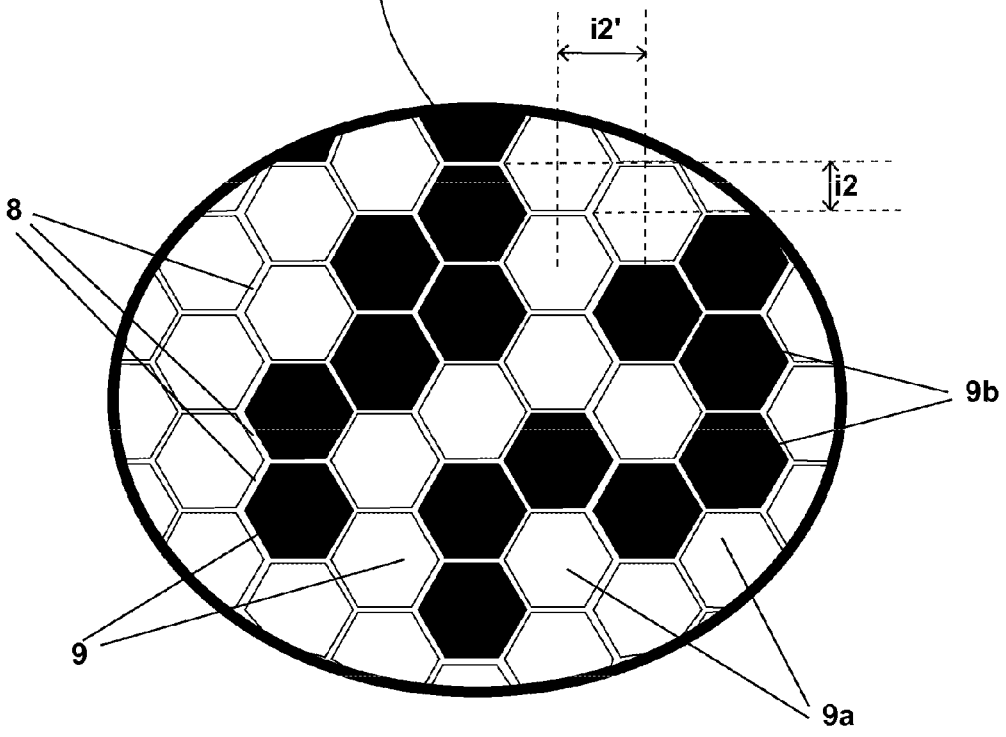
Figure 3:
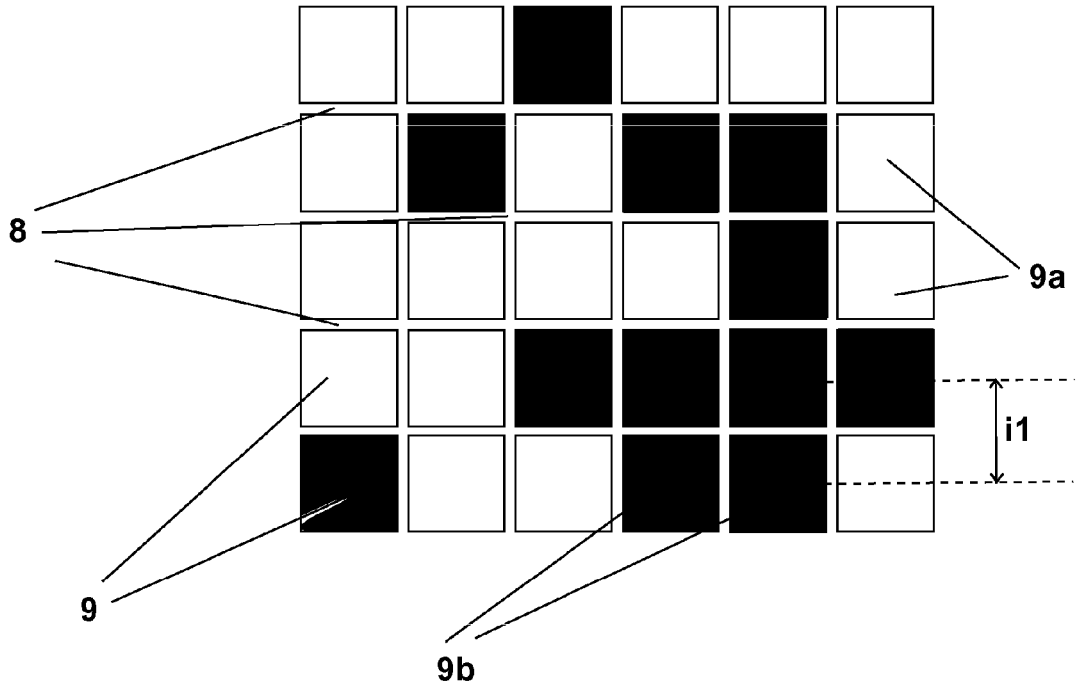
Figure 4:
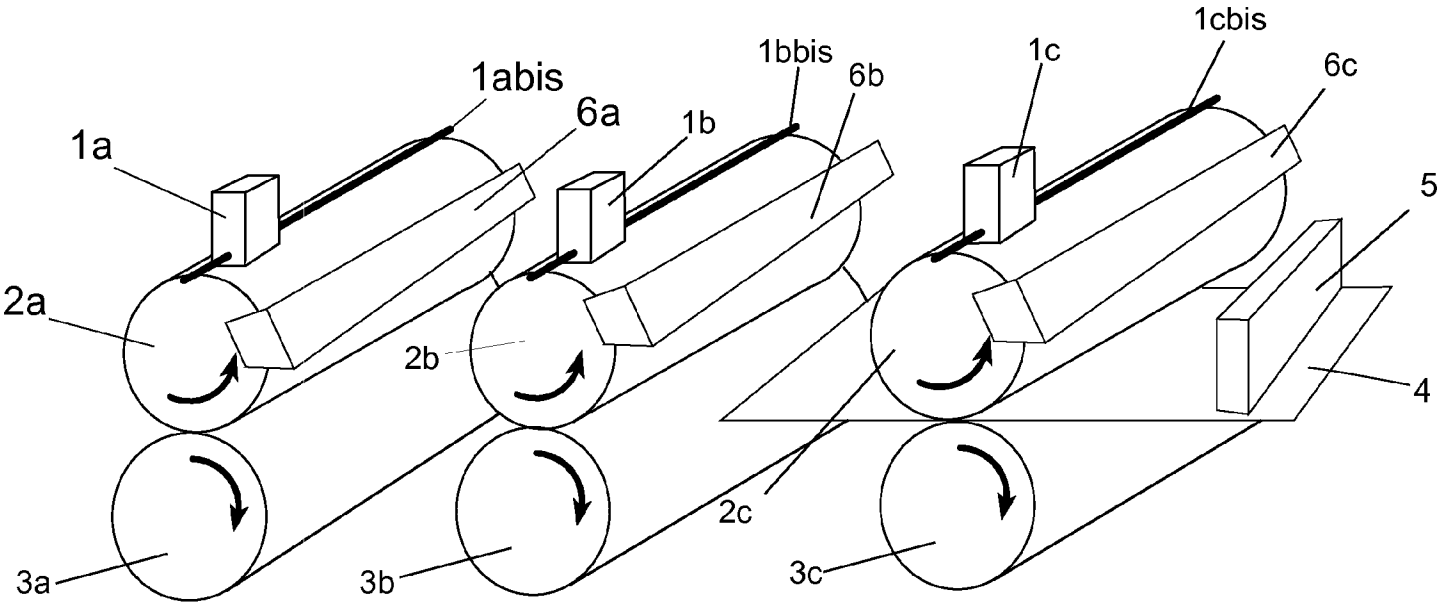

Other particular features and advantages of the present invention will emerge more clearly from the following description hereinbelow, given in reference to the appended drawings, in which:

FIG. 1 illustrates a view in perspective of an embodiment of a coloured matter(s) deposition control and wetting solution device according to the invention, FIG. 2 illustrates a profile view of an offset plate with its deposit means connected to, according to an embodiment, FIG. 2*b* illustrates a diagram of a detail of FIG. 2 according to an embodiment of the surface of the offset plate of the device of the invention, FIG. 3 illustrates a diagram according to another embodiment of the surface of an offset plate of the device of the invention, FIG. 4 illustrates a view in perspective of the printing system operating the device of the invention.

In the present description, the term "wetting solution" should be interpreted widely. This term designates any hydrophilic aqueous solution capable of adhering in an appropriate way to the offset plate on hydrophilic surfaces, being repelled by hydrophobic surfaces and repelling the solution(s) of greasy ink to be printed on the substrate.

Similarly, the term "coloured matter" should be understood via wide interpretation. This term can designate inks of different colours, for example, basic colours such as cyan, yellow and magenta.

Similarly, the term "substrate" should be understood in a wide sense, that is, as any type of flexible or rigid substrate adapted to function with the printing system. These substrates can be types such as cellulosic (paper, carton, wood), composites, textiles or synthetics in continuous mode or sheet-fed mode and the thickness of which can vary from a few tens of micrometers to several centimeters.

The present invention retains the principle of the offset method printing based on the use of at least one universal offset plate (2) whereof the surface is arranged to receive and hold the deposit of a layer of wetting liquid and coloured matters according to a predefined arrangement. The arrangement of the layer of wetting liquid and coloured matters on the surface of the plate is defined by controlled deposit and not only by etching of the surface of the offset plate (2). Therefore, the coloured matter(s) deposition control and wetting solution device is realised by way of the combination of two elements which enable both deposit precisely of the wetting solution and coloured matters on the surface of the offset plate and also holding the arrangement of the wetting liquid deposited on the offset plate.

The device can comprise an offset plate (2) for each colour to carry over to the substrate. Therefore, for example, the device can comprise an offset plate for each basic colour such that a first offset plate (2*a*) reports a coloured matter of a basic colour defined for this offset plate with the wetting solution, then a second offset plate (2*b*) reports a coloured matter of another defined basic colour for the second offset plate with the wetting solution and so on for each basic colour. This example is not limiting. Colours other than the basic colours can be used.

The coloured matter(s) deposition control and wetting solution device of the invention is built with deposit means (1, 1*a*, 1*b*, 1*c*) connected to an offset plate (2, 2*a*, 2*b*, 2*c*) controlled for each offset plate adapted to precisely manage deposit of the wetting liquid and the coloured matter on the surface of the corresponding offset plate (2) connected to the deposit means.

According to an embodiment, the controlled deposit means (1) of the matter or matters and the wetting solution are made, for example, by at least one group of heads comprising at least one deposit head comprising at least one ejection nozzle (100) projecting at least one wetting solution and a deposit head comprising at least one ejection nozzle projecting at least one coloured matter. The ejection nozzle (100) projecting the coloured matter can be, for example, a thermal nozzle using the phenomenon of vaporisation of the coloured matter or coloured matters which are then deposited on the surface of the offset plate (2). The matter(s) is/are deposited precisely onto the offset plate (2). Therefore, each deposit head comprises at least one nozzle controlled individually by a computer system and a digital file. Each head of a deposit means is intended to project at least one wetting solution or a coloured matter onto a surface of an offset plate so that all the projections produce an image and/or a text on the surface of the offset plate corresponding to the image and/or the text of the digital file corresponding to the coloured matter projected by the deposit head projecting a coloured matter and in negative for the head(s) projecting a wetting solution.

The device can be connected for example to the at least one cleaning means (6, 6*a*, 6*b*, 6*c*) for each offset plate (2). This cleaning means (6) can be intended to retrieve the projected residue of coloured matters and/or wetting solution remaining on the surface of the offset plate (2) and which have not been reported to the substrate (4). This cleaning means (6, 6*a*, 6*b*, 6*c*) enables permanent cleaning of the surface of the offset plate prior to projection of new jets of coloured matters and wetting solution. This cleaning means (6, 6*a*, 6*b*, 6*c*) can, for example, be composed of a set of scrapers and rollers. Some rollers and scrapers could be in direct contact with the surface of the offset plate (2). The cleaning device (3) can also comprise blowing means such as for example a wind tunnel. As a function of the physicochemical characteristics of the projected matters, this set can be completed for example and non-limiting by water or solvents addition means, by heating means or cooling means. The cleaning means (6, 6*a*, 6*b*, 6*c*) of the device can comprise a combination of these different devices so as to be polyvalent and be able to clean different types of matter residue.

The device also rests on the surface of the offset plate which is arranged for precise holding of the wetting solution and of the coloured matter deposited on the surface of the plate. Keeping this precision is ensured by an offset plate (2)

which comprises a universal surface adapted to interact with the wetting solution and the deposited coloured matter by fixing it reversibly.

The offset plate (2) has a surface comprising a mesh structure of a plurality of hydrophilic and lipophilic unit areas (9), each of these areas being enclosed by a peripheral hydrophobic and lipophobic delimitation or surface (8) which separates it from its direct neighbours, also hydrophilic. Preferably, the surface of the offset plate (2) creates a mesh structure of hydrophilic and lipophilic unit areas (9) identical to each other and where each of them forms the smallest unit surface likely to receive controlled depositing of wetting liquid and/or coloured matters. Each of these hydrophilic and lipophilic areas (9) has a surface necessary and sufficient for receiving a single dose of wetting solution and/or coloured matters deposited by the deposit means (1). Therefore during deposit of the wetting solution and/or coloured matters by the deposit means (1), the deposit means (1) is positioned opposite a hydrophilic and lipophilic surface, for example being centred on this surface, to project the wetting liquid or coloured matter thereon.

According to a particular embodiment non-limiting feature, each deposit means (1) of the wetting solution is mounted mobile along an axis (1*bis*, 1*abis*, 1*bbis*, 1*cbis*) to enable lateral shifts in a width of the offset plate. Similarly, in a variant combinable with this particular embodiment feature, the axis which bears the deposit means (1) can be mobile to allow displacement of the deposit means (1) in a length of the offset plate. This variant embodiment will be preferred when the offset plate (2) is constructed in the form of a flat structure.

In another particular embodiment feature, displacement of each deposit means (1) in the width of the offset plate (2) can be replaced by the use of a plurality of deposit means placed side by side and positioned to be located opposite a respective deposit unit area (9). Similarly, displacement of the deposit means (1) in the length of the offset plate (2) can be replaced by a displacement of the offset plate itself, for example when the offset plate is formed by the surface of a cylinder. The cylinder, when set in motion by rotation on its axis, enables displacement of the offset plate relative to the deposit means (1).

Depositing of the wetting solution and of the coloured matter on some of the unit areas (9) is predefined as a function of the image which must be printed. Preparation of the image to be printed, at the level of one or more adapted devices (10), can require programming, for example automated, of the projection of the wetting solution and the coloured matter in correlation with displacement of the deposit means (1) relative to the offset plate (2).

According to a particular embodiment feature, the offset plate (2) has a surface comprising a mesh structure of a plurality of hydrophilic and lipophilic unit areas (9) capable of retaining or fixing a matter, respectively, aqueous and greasy. Each of these areas is enclosed by a peripheral at least lipophobic area for repelling greasy matters such as ink. A peripheral hydrophilic area can also suit, such as glass or stainless steel for example, as it will constantly be wet by the aqueous matter (i.e. the wetting solution) and will not be inundated by the greasy matters. Preferably, a peripheral hydrophobic and lipophobic area (8) capable of repelling the matter can be used, respectively, aqueous and greasy, such as Teflon for example. In general, therefore the materials and/or the surface treatment of materials within the mesh structure of the offset plate are adapted as a function of the type of matter to be deposited, especially its surface tension, such that the unit areas confine the matter deposited (either wetting solution, or ink) and preferably the peripheral areas are not inundated by ink (greasy in this case).

According to a particular embodiment, the different unit areas (9) for fixing deposits of wetting liquid and coloured matters are arranged on the surface of the offset plate (2) so as to form a mesh structure. This mesh structure positions the hydrophilic and lipophilic unit areas (9) relative to each other to allow a grid pattern which divides the entire surface of the offset plate into a plurality of unit areas (9) respectively selected by the deposit means (1) of each offset plate. In a non-limiting way, according to a first variant of the embodiment of this mesh structure, the unit areas (9) are of rectangular form, or even square, such that the mesh structure of the offset plate creates checkering. According to a second variant of the embodiment of this mesh structure, the different unit areas (9) have a hexagonal form to allow an arrangement between them which is a honeycomb. The advantage of this second variant embodiment is to propose unit areas the form of which is close to a circle. This form is better adapted to receive the deposit of a drop of wetting liquid and/or coloured matter. The hexagonal form of the different lipophilic and hydrophilic unit areas (9) on the offset plate (2) reconciles an arrangement of these different areas together to allow an optimal mesh structure of the entire surface of the offset plate and be adapted to the roundness of drops of wetting solution and/or coloured matter which are likely to be deposited thereon.

The different lipophilic and hydrophilic unit areas (9) on the surface of the offset plate (2) are separated by lipophobic and hydrophobic peripheral areas (8) which can, for example, create continuity between them. Each of the lipophilic and hydrophilic unit areas (9) is therefore enclosed by a hydrophobic and lipophobic area (8). According to a particular embodiment of the invention, a hydrophobic and lipophobic area (8) which separates two consecutive lipophilic and hydrophilic areas (9) has a width of between 5 and 50% of the width of a lipophilic and hydrophilic area (9). According to a particular embodiment feature, the hydrophobic and lipophobic areas (8) are arranged so that their width is both large enough to individualise each of the hydrophilic and lipophilic areas and prevent deposit of wetting solution and coloured matter to shift from one unit area to another, and also be sufficiently restrained so that the repellent effect of the deposit of wetting solution or coloured matter on two consecutive unit areas has a repelling effect sufficient to prevent spreading of the wetting solution and/or of the coloured matter out of the unit area on which the solution or the matter has been deposited. Similarly, the width of a unit area (9) is of the order of at least 10 μm to 50 μm, preferably 20 μm to 40 μm, ideally 35 μm. This particular width creates a unit area which is adapted to optimally receive the deposit of a drop of wetting solution or coloured matter. This width can also have a dimension of at least 5 μm.

Each offset plate is set in motion by displacement means which set in motion the offset plate incrementally between each deposit of deposited matter(s) by the nozzle(s) at the centre of at least one unit surface. Each increment depends on the form of the unit area so that each unit area can face a nozzle projecting a wetting solution or colour matter. Each increment can correspond to the size of at least one demi-cell.

In the case of cells of rectangular form, each increment (i1) corresponds to the size of an cell.

In the case of cells of hexagonal form, each increment (i2) corresponds to the size of a demi-cell. In this case, there can be several variants. In a first variant, at each increment of movement of the offset plate, the offset plate is shifted longitudinally by an increment (i2') of the size of a cell so that each nozzle is facing the centre of a unit surface. In a second variant, at each increment of movement of the offset plate, the group or groups of heads are shifted longitudinally and parallel to the offset plate by an increment (i2') of the size of a cell so that each nozzle is facing the centre of a unit surface. In a third variant, each group of heads has at least two nozzles separated by the size (i2') of a cell, one of the nozzles projecting matter at an increment and the other nozzle projecting matter at the following increment.

The aim of the control device of the wetting of the invention is to integrated into a printing system which comprises especially a coloured matter(s) deposition control and wetting solution device (3) and a counterpressure roller (3*a*, 3*b*, 3*c*) for each offset plate for transfer of the image from the surface of each offset plate to the surface of a substrate (6). The substrate passes therefore between the counterpressure cylinder(s) (3*a*, 3*b*, 3*c*) and the offset plate(s). This/These cylinder(s) can play a support role of the substrate at the time of the carryover or of the transfer of the deposit of the wetting solution and coloured matters. The printing system can also comprise a drying device (5) intended to dry the wetting solution and/or dry or polymerise the coloured matter(s) deposited on the substrate (4) by the device according to the invention. The drying device (5) can be for example a source of heat or any other drying means placed after the device according to the invention. As per the characteristics of the matters used, the drying device (5) could for example and non-restrictively be a source of heat, a polymerisation system by ultraviolet, infrared, electron beams, or any other source of polymerisation. The advantage of drying by polymerisation is that a dry matter is obtained without expending much energy. Also, the film of polymerising matter, after polymerisation, is highly resistant to abrasion, ageing, light, humidity . . . . In another configuration, the device can comprise a drying device placed after each offset plate.

In an embodiment, the system can comprise also a printing blanket disposed between the offset plate (2*a*, 2*b*, 2*c*) and the substrate (4). The substrate (4) can therefore pass between the printing blanket and the counterpressure cylinder(s) (3*a*, 3*b*, 3*c*). The printing blanket receives the coloured matter(s) and/or the wetting solution and transfers the coloured matter(s) and/or the wetting solution received to the substrate (4).

The method for implementing the device of the invention comprises especially at least successively:

- at least one step for controlled deposit of wetting solution (E1) on the offset plate (2) comprising a plurality of hydrophilic and lipophilic unit surfaces separated by peripheral hydrophobic surfaces or lipophobic by the nozzle(s) for deposit of the wetting solution of the deposit means of an offset plate,
- at least one step for controlled deposit of coloured matter on the offset plate (2) with especially repelling of the coloured matter by the peripheral lipophobic and hydrophobic surfaces of the offset plate (2) by the nozzle(s) for deposit of coloured matter of the deposit means of the same offset plate.
- a carryover step of the wetting solution and of the coloured matter deposited on the offset plate (2) on a substrate.

These three steps are repeated for each offset plate (2*a*, 2*b*, 2*c*).

Therefore, in an example where each offset plate corresponds to a basic colour, these steps are performed by the first offset plate (2*a*) corresponding to the basic colour cyan, then these steps are repeated for the second offset plate (2*b*) corresponding to the basic colour magenta and finally these steps are repeated for the third offset plate (2*c*) corresponding to the basic colour yellow. Each time these three steps are performed, the substrate (4) is advanced by displacement means to each offset plate for performing these three steps.

The wetting solution is projected by the nozzles into determined unit areas. The hydrophilic properties of the unit areas and the hydrophobic properties of the peripheral areas each keep a wetting solution deposit in the unit area (9*a*) in which it has been deposited. The wetting solution is projected into the determined unit areas (9*a*) where the deposit of colour matters following deposit of the wetting solution is not wanted. The colour matters can be, for example, greasy inks. Therefore, the lipophilic properties of the unit areas and the lipophobic properties of the peripheral areas each keep a deposit of colour matters in the unit area (9*b*) in which it has been deposited. Also, due to the water-grease repelling principle, the colour matters do not enter the unit areas where a wetting solution has been deposited.

Upstream of the steps for controlled deposit of wetting solution and controlled deposit of coloured matter, the method of the invention can also comprise:

- a preparation step of the image to be printed comprising at least determination and programming of the part(s) of the surface of the offset plate intended to receive wetting solution and of the part(s) of the surface of the offset plate intended to receive the coloured matter,
- a transfer step of programmed data corresponding to the image to be printed to the coloured matter(s) deposition control and wetting solution device.

Downstream of the steps for controlled deposit of wetting solution, controlled deposit of coloured matter and carryover, and after all the offset plates have reported the wetting solution and the coloured matters, the method comprises a drying step by the drying device of the wetting solution and coloured matters.

In the configuration where a drying device is arranged after each offset plate, drying can take place after each carryover of the wetting solution and coloured matter.

It must be evident for experts that the present invention enables embodiments in many other specific forms without departing from the field of application of the invention as claimed. Consequently, the present embodiments must be considered by way of illustration, but can be modified in the field defined by the scope of the appended claims, and the invention does not have to be limited to the details given hereinabove.

The invention claimed is:

1. A matter(s) deposition control device for an offset printing system (0) comprising:

- at least one offset plate (2, 2*a*, 2*b*, 2*c*) configured to receive successively a wetting liquid and a coloured matter,
- at least one controlled deposit means (1, 1*a*, 1*b*, 1*c*) for each offset plate (2, 2*a*, 2*b*, 2*c*), the at least one controlled deposit means (1, 1*a*, 1*b*, 1*c*) comprising at least one deposit head projecting at least one wetting solution and at least one deposit head projecting a defined coloured matter,
- at least one cleaning means (6*a*, 6*b*, 6*c*) of the offset plates (2, 2*a*, 2*b*, 2*c*), and a coating of the at least one offset plate (2, 2*a*, 2*b*, 2*c*) comprises a mesh structure defined by a plurality of hydrophilic and lipophilic unit surfaces (9, 9*a*, 9*b*) configured to receive controlled deposit of wetting liquid and/or coloured matter, each of these hydrophilic and lipophilic unit surfaces being separated from each other by at least one hydrophobic and lipophobic surface (8) peripheral to each of the hydrophilic and lipophilic unit surfaces.

2. The matter(s) deposition control device for an offset printing system according to claim 1, wherein each deposit head comprises at least one nozzle individually controlled by a computer system and a digital file, each head of a deposit means (1, 1*a*, 1*b*, 1*c*) being configured to project at least one wetting solution or one coloured matter on a surface of an offset plate (2, 2*a*, 2*b*, 2*c*) so that all the projections produce an image and/or a text on the surface of the offset plate (2, 2*a*, 2*b*, 2*c*) corresponding to the image and/or the text of the digital file corresponding to the coloured matter projected by the deposit head projecting a coloured matter and in negative for the at least one deposit head projecting a wetting solution.

3. The matter(s) deposition control device for an offset printing system according to claim 1, wherein the mesh structure comprises unit surfaces (9, 9*a*, 9*b*) of rectangular form arranged relative to each other so as to form checkering of the surface.

4. The matter(s) deposition control device for an offset printing system according to claim 1, wherein the mesh structure comprises unit surfaces (9, 9*a*, 9*b*) of hexagonal form arranged relative to each other so as to form a honeycomb meshing of the surface.

5. The matter(s) deposition control device for an offset printing system according to claim 1, wherein the value of the width of a peripheral lipophobic and hydrophobic surface (8) corresponds to a value of between 5 to 50% of the width of a lipophilic and hydrophilic unit surface (9, 9*a*, 9*b*).

6. The matter(s) deposition control device for an offset printing system according to claim 1, wherein the width of a unit surface (9, 9*a*, 9*b*) configured to receive wetting liquid or coloured matter is at least equal to or greater than 35 .mu.m.

7. The matter(s) deposition control device for an offset printing system according to claim 1, wherein the width of a unit surface (9, 9*a*, 9*b*) configured to receive wetting liquid or coloured matter is at least equal to 5 .mu.m.

8. The matter(s) deposition control device for an offset printing system according to claim 1, wherein the at least one offset plate (2, 2*a*, 2*b*, 2*c*) are configured to be set in motion by displacement means, the displacement means setting in motion the at least one offset plate incrementally between each deposit of wetting solution and/or coloured matter deposited by at least one nozzle at the centre of at least one unit surface (9, 9*a*, 9*b*), each increment corresponding to the size of a demi cell.

9. The matter(s) deposition control device for an offset printing system according to claim 1, wherein the number of offset plates (2*a*, 2*b*, 2*c*) corresponds to the number of basic colours.

10. A printing system, wherein the printing system integrates the matter(s) deposition control device according to claim 1.

11. The printing system according to claim 10, wherein the printing system further comprises a drying device (5) intended to dry the wetting solution and/or the coloured matters deposited on a substrate (4).

12. The printing system according to claim 10, wherein the system comprises a counterpressure cylinder (3*a*, 3*b*, 3*c*) for each offset plate, a substrate passing between at least one counterpressure cylinder and one of the at least one offset plate.

13. The printing system according to claim 10, wherein the system comprises a counterpressure cylinder for each offset plate and at least one printing blanket for each offset plate (2*a*, 2*b*, 2*c*), a substrate passing between at least one counterpressure cylinder (3*a*, 3*b*, 3*c*) and the at least one printing blanket.

14. A printing method operating the device according to claim 1, wherein the method comprises successively at least:

at least one step for the controlled deposit of wetting solution on the at least one offset plate comprising the plurality of hydrophilic and lipophilic unit surfaces separated by peripheral hydrophobic and lipophobic surfaces by at least one nozzle for deposit of the wetting solution of the deposit means of the at least one offset plate, at least one step for the controlled deposit of coloured matter on the at least one offset plate with repelling of the coloured matter by the peripheral lipophobic and hydrophobic peripheral surfaces of the at least one offset plate by the at least one nozzle for deposit of coloured matter of the at least one controlled deposit means of the at least one offset plate, a carryover step of the wetting solution and of the coloured matter deposited on the at least one offset plate on a substrate, all of these steps being repeated successively for each offset plate.

15. The printing method according to claim 14, wherein prior to the steps for controlled deposit of wetting solution, controlled deposit of coloured matter and carryover, the method comprises:

a preparation step of the image to be printed comprising at least determination and programming of the part(s) of the surface of the offset plate intended to receive wetting solution and/or coloured matter, a transfer step of programmed data corresponding to the image to be printed to the matter(s) deposition control device.

16. The printing method according to claim 14, wherein the steps for controlled deposit of wetting solution, controlled deposit of coloured matter and carryover are repeated for each offset plate corresponding to each basic colour.

17. The printing method according to claim 16, wherein following the steps for controlled deposit of wetting solution, controlled deposit of coloured matter and carryover performed for all the offset plates, the method comprises a drying step by a drying device of the wetting solution and coloured matters.

* * * * *